US006000948A

United States Patent [19]

Peterson

[11] Patent Number: 6,000,948

[45] Date of Patent: Dec. 14, 1999

[54] ROTATABLE CONNECTOR FOR A MICROPHONE

[76] Inventor: John O. Peterson, 3157 CR. 774, Webster, Fla. 33597

[21] Appl. No.: 09/082,942

[22] Filed: May 21, 1998

[51] Int. Cl.[6] ..... H01R 39/00

[52] U.S. Cl. ..... 439/22

[58] Field of Search ..... 439/22, 21, 20, 439/18, 27, 29

[56] References Cited

U.S. PATENT DOCUMENTS

| | | | |
|---|---|---|---|
| Re. 32,805 | 12/1988 | Engelmore et al. | 439/24 |
| 2,265,846 | 11/1941 | Krantz . | |
| 4,273,969 | 6/1981 | Foley et al. | 439/13 |
| 4,590,337 | 5/1986 | Engelmore | 439/22 |
| 4,773,866 | 9/1988 | Basques | 439/21 |
| 4,850,880 | 7/1989 | Zayat, Jr. et al. | 439/26 |
| 4,921,429 | 5/1990 | Brown | 439/26 |
| 4,932,882 | 6/1990 | Kang | 439/22 |
| 5,106,306 | 4/1992 | Ditzig | 439/26 |
| 5,435,731 | 7/1995 | Kang | 439/26 |
| 5,690,498 | 11/1997 | Sobhani | 439/22 |

*Primary Examiner*—Gary F. Paumen

*Attorney, Agent, or Firm*—Kenneth L Tolar

[57] ABSTRACT

The present invention relates to a connector assembly for a microphone which allows the microphone and cord to be independently rotated thereby preventing the cord from twisting and distorting. The device includes a first connector having a cylindrical housing with a plurality of female ports on an end thereof for receiving the male prongs on an end of the microphone. Received within the cylindrical housing proximal the opposing end are a plurality of spring biased pins in electrical communication with the ports. The device also includes a second connector having a cylindrical housing which may be rotatably coupled to the first connector. An end of the housing is open and has a horizontal, substantially circular circuit board proximal thereto. On the upper surface of the circular circuit board are a plurality of concentric electrically conductive paths. Received within the second connector proximal the opposing end are a plurality of electrical contacts for selectively engaging conventional receptacles on a microphone cord plug. The assembly interconnects the microphone and cord so that as the microphone is rotated relative to the cord, electrical communication therebetween is maintained due to the spring biased pins sliding along the circular conductive paths.

4 Claims, 2 Drawing Sheets

ROTATABLE CONNECTOR FOR A MICROPHONE

BACKGROUND OF THE INVENTION

The present invention relates to an electrical connector for a microphone which allows the cord to independently rotate relative thereto to prevent the cord from twisting or entangling.

DESCRIPTION OF THE PRIOR ART

Public speakers and performers often use a microphone to amplify their voices. The microphone often includes an elongated handle having a mouth piece at one end and a cord fixedly connected to the other in communication with an amplifier. Because the microphone is typically moved between various users and locations, the cord often becomes twisted and entangled. Accordingly, there is currently a need for a device which will allow the cord to rotate relative to the microphone while maintaining electrical communication therebetween.

Various rotating electrical connectors, most of which are designed for telephones, exist in the prior art. However, none relate to a convenient and inexpensive to manufacture device according to the present invention that is specifically designed for a microphone. For example, U.S. Pat. No. 5,435,731 issued to Kang discloses a rotatable hidden connector for a telephone transmitter. The connector includes a housing, four conductors on a rotation seat which has four sets of annular guide pieces thereon. The annular guide pieces are composed of piercing members which pierce the outer layer of the conductors to electrically connect thereto. Four electrically conducting spring strips are in sliding contact with a guide piece, the strips being disposed on a jack received within a phone mouth piece.

U.S. Pat. No. 5,106,306 issued to Ditzig discloses a rotary electrical connector comprising a housing having a female modular connector therein. The housing further includes a sub-assembly comprising a spindle and a connector member which engages a shank of the spindle. The housing and the female modular connector rotate as a unit relative to the sub-assembly.

U.S. Pat. No. 4,921,429 issued to Brown discloses a rotatable bulb socket assembly comprising a non-conductive cylindrical base for receiving a base portion of a light bulb. The device further includes electrically conductive brushes to connect a power supply to the assembly allowing the base to rotate.

U.S. Pat. No. 4,850,880 issued to Zayat, Jr. et al discloses an anti-tangle swivel electrical connector for a telephone.

U.S. Pat. No. 4,773,866 issued to Basques discloses a rotatable electrical connector for telephone cords including a flat face having electrically conductive contact rings thereon with four sliding contacts in communication therewith. The mating connectors have male or female telephone plug members thereon for connecting a telephone cord to a phone.

U.S. Pat. No. 2,265,846 issued to Krantz discloses a swivel connector for a telephone.

Although various rotating electrical connectors exist in the prior art, none are designed for or capable of being used with a microphone. The present invention provides a two piece electrical connector assembly specifically configured to couple a microphone to a cord allowing the two to independently rotate thereby preventing the cord from twisting or tangling.

SUMMARY OF THE INVENTION

The present invention relates to a coupling device for connecting a microphone cord to a microphone. The device comprises a first cylindrical connector member having a plurality of prong receiving ports on an end thereof for securing to an end of a microphone. Protruding from opposing ends are a plurality of spring biased pins made from an electrically conductive material. The device further includes a second cylindrical connector member having an open end with a plurality of tubular electrical contacts protruding from an opposing end for selectively engaging a microphone cord plug. Adjacent the open end is a circular horizontal, circuit board having a plurality of concentric electrically conductive paths on its upper surface. The housing of the first connector is configured to be rotatably received within the open end of the second connector member. It is therefore an object of the present invention to provide an electrical connector for a microphone which allows the microphone and cord to independently rotate.

It is yet another object of the present invention to provide an electrical connector for a microphone that prevents the microphone cord from twisting, tangling or distorting.

It is yet another object of the present invention to provide an electrical connector for a microphone that is easy to use and inexpensive to manufacture. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
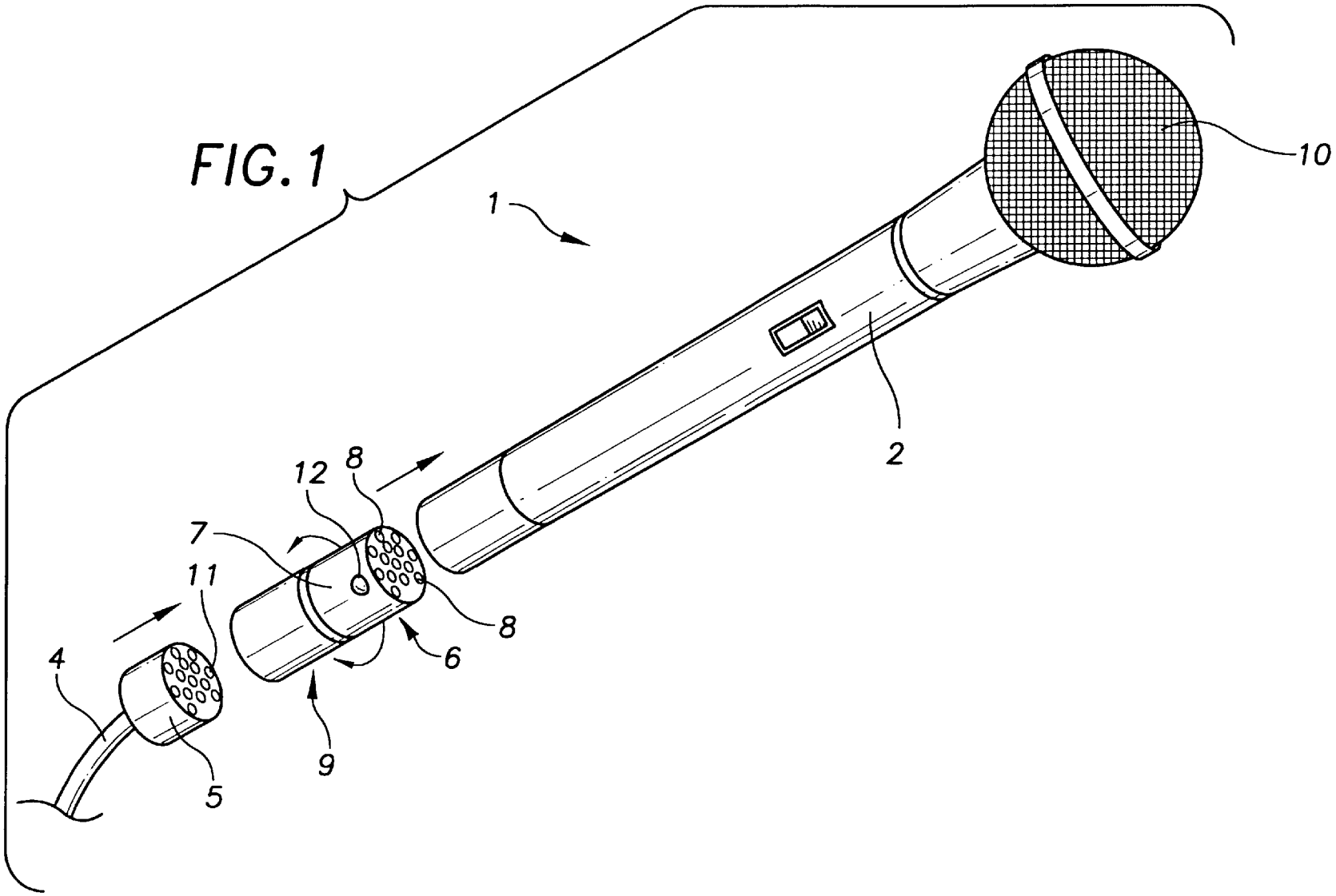
FIG. 1 depicts the inventive device partially offset from a microphone.
Figure 3:
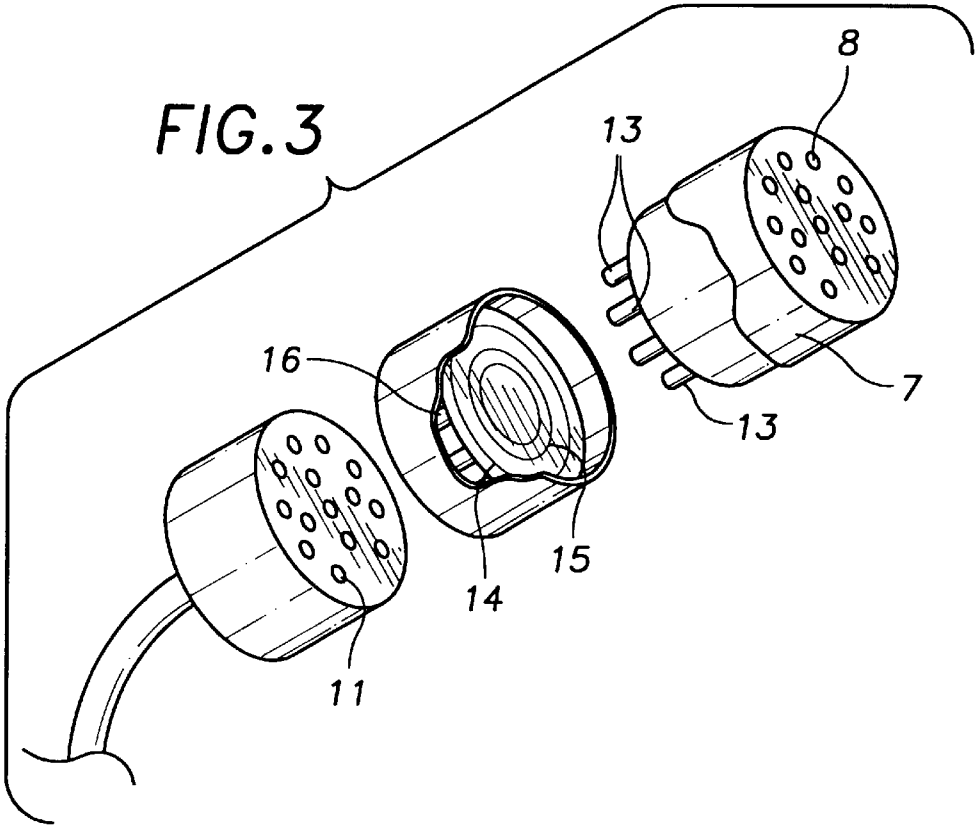
FIG. 3 is an exploded view of the inventive device with a partial cut away view of the second connector member depicting the circuit board.
Figure 2:
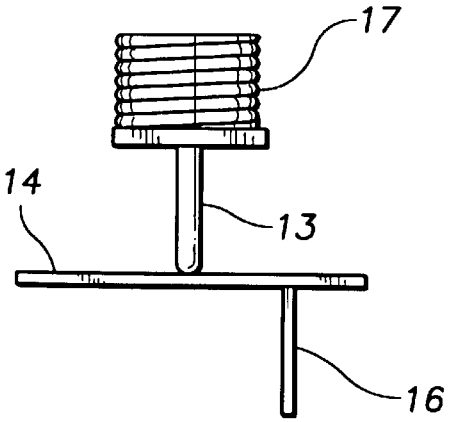
FIG. 2 is a detail of the spring biased pin and circular circuit board assembly.

Referring now to FIGS. 1 through 3, the present invention relates to an electrical connector for a microphone which allows the microphone and cord to be rotatably coupled. A conventional microphone 1 typically includes an elongated tubular handle 2 having a spherical member 10 a first end thereof into which a user speaks to amplify his or her voice. The opposing end of the tubular shaft has a recessed portion 3 with a plurality of male type electrical prongs received therein. The electrical prongs are in communication with the microphone internal wiring. A conventional microphone cord 4 has a plug member 5 at a distal end with a plurality of female ports 11 on its upper surface for receiving the prongs in the microphone recessed portion allowing the cord to be removably attached thereto.

The present invention relates to a connector assembly for a conventional microphone as described above for rotatably coupling the cord thereto. The device comprises a first connector member 6 having a cylindrical housing 7 with upper and lower ends. On the upper end are a plurality of female electrical ports 8 dimensioned and spaced identically as those on the microphone cord plug. Extending from the opposing end are a plurality of spring 17 biased pins 13 dimensioned and spaced identically as the electrical prongs within the recessed portion of a microphone. On the exterior surface of the first connector member housing is a light emitting diode (LED) 12 in communication with the ports and spring biased pins for visually indicating to a user that the cord and microphone are electrically connected.

The device also includes a second connector member 9 comprising a cylindrical housing having upper and lower ends. The upper end is open and is dimensioned to rotatably receive the lower end of the first connector member. Means for securing the two housings together such as snaps or similar means may also be included. Received within the housing and proximal its upper end is a horizontal, substantially circular circuit board 14 having a plurality of concentric electrically conductive paths 15 on its upper surface. Extending from the lower surface of the circuit board are a plurality of elongated tubular electrical contacts 16 spaced and dimensioned similar to the prongs extending from the recessed end of the microphone. Each of the contacts is in electrical communication with one of the concentric conductive paths.

To use the above described device, the upper end of the first connector housing is inserted into the recessed end of the microphone handle. The lower end of the second connector member housing is coupled with the plug on the microphone cord. The first connector is then inserted into the second connector member housing establishing communication between the microphone and cord. As the microphone rotates relative to the cord, electrical communication therebetween is maintained since the spring loaded pins will slide along the concentric, electrically conductive paths. As long as electrical communication is established, the LED will be illuminated.

The housings of the two connector members are preferably made with plastic though any material will suffice. The conductive paths are preferably constructed with copper or a similar conductive material. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a microphone having an elongated handle with a mouthpiece at one end thereof and a recessed portion at the other end thereof having a plurality of electrical prongs received therein for coupling with a plurality of receptacles on a plug member attached to a cord, an electrical connector assembly comprising:

a first connector member having a cylindrical housing with first and second ends, a plurality of ports at a first end thereof spaced and dimensioned to receive said prongs within the recessed portion of said microphone;

a second connector rotatably and electrically coupled with said first connector;

said second connector including a cylindrical housing having an open end and an opposing end with a plurality of tubular electrical contacts extending therefrom dimensioned and spaced to couple with said receptacles on said cord plug;

means for maintaining electrical communication between said cord and said microphone when said first connector is rotated relative to said second connector.

2. The combination according to claim 1 wherein said means for maintaining electrical communication between said cord and microphone comprises:

a plurality of spring biased pins protruding from the second end of said first connector member in communication with said ports;

a circular circuit board having an upper surface received within said second connector member housing and proximal its open end having a plurality of concentric, electrically conductive paths on its upper surface on which said pins slide, said paths in electrical communication with said electrical contacts protruding from its opposite end.

3. A device according to claim 2 further comprising a light emitting diode on the exterior surface of said first connector member housing in communication with said pins and said ports to visually indicate that said cord and said microphone are electrically connected.

4. A device according to claim 3 wherein the open end of said second connector member housing is dimensioned to rotatably receive the second end of said first connector allowing said first and second connector members to be conveniently and rotatably coupled.

* * * * *